United States Patent [19]

Penning

[11] Patent Number: 4,747,936

[45] Date of Patent: May 31, 1988

[54] DEASPHALTING AND DEMETALLIZING HEAVY OILS

[75] Inventor: Richard T. Penning, Chicago, Ill.

[73] Assignee: UOP Inc., Des Plaines, Ill.

[21] Appl. No.: 947,115

[22] Filed: Dec. 29, 1986

[51] Int. Cl.[4] ..... C10G 21/02; C10G 21/00

[52] U.S. Cl. ..... 208/251 R; 208/309; 208/45; 196/14.52

[58] Field of Search ..... 208/45, 251 R, 309; 196/14.52

[56] References Cited

U.S. PATENT DOCUMENTS

| | | | |
|---|---|---|---|
| 3,775,292 | 11/1973 | Walkins | 208/309 |
| 3,779,902 | 12/1973 | Mitchell et al. | 208/309 |
| 3,380,732 | 8/1974 | Gatsis | 208/309 |
| 3,972,807 | 8/1976 | Uitti et al. | 208/309 |
| 4,124,486 | 11/1978 | Nolley, Jr. | 208/95 |
| 4,239,616 | 12/1980 | Gearhart | 208/309 |
| 4,273,644 | 6/1981 | Harris et al. | 208/309 |
| 4,278,529 | 7/1981 | Gearhart | 208/309 |
| 4,279,739 | 7/1981 | Rouch | 208/309 |
| 4,290,880 | 9/1981 | Leonard | 208/309 |
| 4,305,814 | 12/1981 | Leonard | 208/309 |
| 4,354,928 | 10/1982 | Aucleh et al. | 208/309 |
| 4,482,453 | 11/1984 | Coombs et al. | 208/309 |
| 4,502,944 | 3/1985 | Nelson | 208/45 |
| 4,548,711 | 10/1985 | Coombs et al. | 208/309 |

*Primary Examiner*—Helen M. S. Sneed
*Assistant Examiner*—Helane Myers
*Attorney, Agent, or Firm*—Thomas K. McBride; John F. Spears, Jr.; Richard J. Cordovano

[57] ABSTRACT

An improved method for deasphalting and demetallizing heavy oils, where the improvement is a counterflow washing step which increases the yield of the product oil. A heavy oil feedstream is contacted in a countercurrent manner with a solvent in a multi-stage extraction zone and a resulting light phase stream is heated and passed into a settling zone. A second light phase stream comprised of the product deasphalted and demetallized oil and solvent is separated from a contaminant-laden heavy phase in the settling zone. The contaminant-laden heavy phase, which is termed a resin phase, contains an equilibrium amount of DMO and solvent. DMO-enriched solvent is displaced from the resin stream by means of a counterflow washing process using pure solvent.

10 Claims, 1 Drawing Sheet

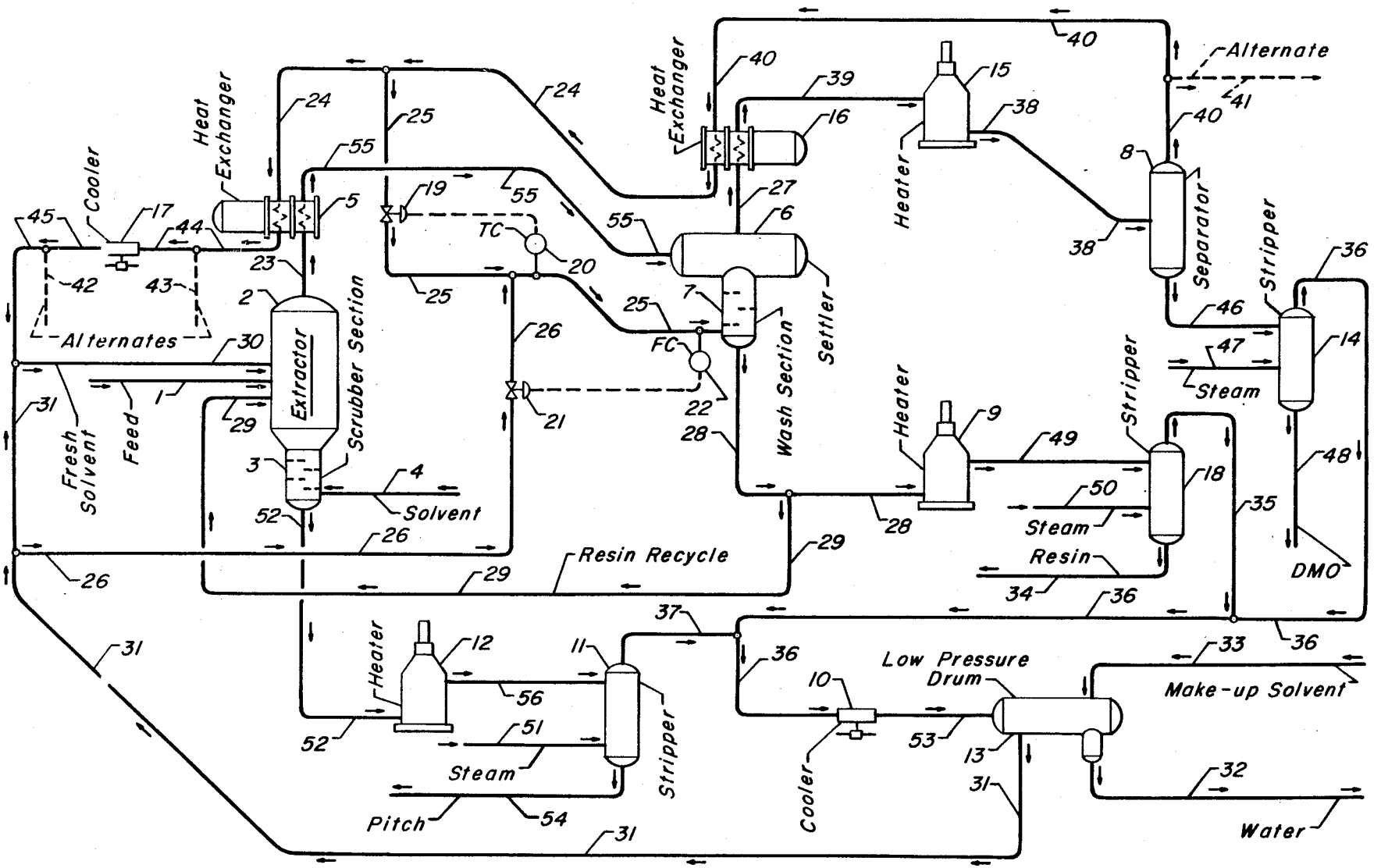
Alternate
Separator
Stripper
Steam
DMO
Stripper
Steam
Resin
Make-up Solvent
Water
Heater
Heater
Settler
Wash Section
Heat Exchanger
Resin Recycle
Low Pressure Drum
Cooler
Stripper
Heater
Steam
Pitch
Solvent
Scrubber Section
Extractor
Heat Exchanger
Cooler
Alternates
Feed
Fresh Solvent

DEASPHALTING AND DEMETALLIZING HEAVY OILS

FIELD OF THE INVENTION

This invention relates to the art of solvent extraction. Heavy hydrocarbon oils are subjected to extraction processes in order to obtain useful products, where one of the products is substantially free of contaminants present in the heavy oil. More specifically, this invention relates to separating heavy oils into two or three components by utilizing solvents and changes in their physical properties resulting from variation of temperature and pressure.

BRIEF SUMMARY OF THE INVENTION

The present invention is an improved method for deasphalting and demetallizing heavy oils, where the improvement is a counterflow washing step which increases the yield of the product oil. The process of the present invention is an extension of the well-known propane deasphalting process, where the product is termed deasphalted oil (DAO). Product from the deasphalting and demetallizing process described herein is termed demetallized oil (DMO) in order to distinguish the process of the present invention from propane deasphalting.

The primary object of the process of the present invention is to recover non-distillate oils from heavy oils such as vacuum residua. The product DMO is relatively free of resins and asphaltenes, high molecular weight condensed ring aromatics and compounds containing metals, sulfur, and nitrogen. In the practice of the invention, a heavy oil feedstream is contacted with a solvent in an extraction zone and a resulting light phase stream is heated and passed into a settling zone. A second light phase stream comprised of the product deasphalted and demetallized oil and solvent is separated from a contaminant-laden heavy phase in the settling zone. The contaminant-laden heavy phase, which is termed a resin phase, contains an equilibrium amount of DMO and solvent. DMO-enriched solvent is displaced from the resin stream by means of a counterflow washing process using pure solvent.

The counterflow wash may be accomplished in a vessel which is attached to and in communication with the settling zone, so that the recovered DMO-enriched solvent leaves the settling zone with the second light phase stream or the wash may be accomplished in an entirely separate vessel. The DMO stream is recovered by separating solvent from the second light phase stream, preferably by means of supercritical solvent recovery.

The pure solvent which is introduced into the counterflow washing apparatus may be controlled at a particular temperature by blending a portion of a relatively cold solvent stream with a portion of a hot solvent stream emanating from the DMO/solvent separation apparatus of the process. The cold solvent stream is recovered from two separate stripping zones in which a final separation of DMO and solvent is made and a product pitch stream is separated from solvent. If a third product is withdrawn from the process, a portion of the cold solvent stream is recovered from a stripping zone in which a resin stream is separated from solvent. Temperature control of the pure solvent stream used to accomplish the wash is necessary to prevent over-precipitation in the event that the solvent is too hot and to prevent re-dissolution if the solvent is too cold.

In a broad embodiment, the invention comprises supplying a hydrocarbon feed stream comprising a heavy oil to an extraction zone; supplying a fresh solvent stream to said extraction zone; contacting said hydrocarbon feed stream with said fresh solvent stream in said extraction zone and recovering therefrom a first light phase stream and a first heavy phase stream; heating said first light phase stream and supplying said first light phase stream to a settling zone, wherein a second light phase stream comprising solvent and deasphalted and demetallized oil is separated from a second heavy phase stream comprising resins, oil, and solvent; countercurrently contacting said second heavy phase stream with a wash solvent stream in a resin wash zone in order to obtain a third light phase stream comprising solvent and deasphalted and demetallized oil and a third heavy phase stream comprising resins and solvent; combining said second light phase stream with said third light phase stream, heating the combined stream, and supplying the combined stream to a separation zone; recovering from said separation zone a fourth light phase stream comprised of solvent and a fourth heavy phase stream comprised of solvent and deasphalted and demetallized oil; and, passing at least a portion of said fourth heavy phase stream into a first steam stripping zone and recovering therefrom a stream comprising solvent and water and a stream comprising deasphalted and demetallized oil.

The process of the invention further comprises supplying at least a portion of said third heavy phase stream to said extraction zone as a recycle stream; optionally contacting at least a portion of said first heavy phase stream with steam in a second steam stripping zone and recovering therefrom a pitch stream and a stream comprised of solvent and water; contacting at least a portion of said third heavy phase stream with steam in a third steam stripping zone and recovering therefrom a resin stream and a stream comprised of solvent and water; combining a make-up solvent stream with said solvent and water streams from said first, second, and third steam stripping zones and separating said combined stream into a water stream and a cold solvent stream; mixing a first portion of said cold solvent stream with a first portion of said fourth light phase stream to form said wash solvent stream; and, mixing a second portion of said cold solvent stream and a second portion of said fourth light phase stream to form said fresh solvent stream which is provided to the extraction zone.

INFORMATION DISCLOSURE

In U.S. Pat. No. 4,502,944 (Nelson), a process is disclosed in which a hydrocarbon is separated into three phases in a first separation zone. A heavy phase comprising asphaltenes is withdrawn from the first separation zone and passed to a stripper for separation of solvent from the asphaltenes. A light phase is recovered from the first separation zone, heated, and passed into a second separation zone which operates at supercritical conditions. In the second separation zone, a heavy phase comprising oils and a light phase comprising solvent is produced. An intermediate phase comprising resins is also withdrawn from the first separation zone.

U.S. Pat. No. 4,290,880 (Leonard) teaches a process for producing a low metals content deasphalted oil from a heavy hydrocarbon material. A heavy hydrocarbon and a solvent are introduced into a first separation zone which is maintained at a temperature at least equal to the critical temperature of the solvent and a pressure at least equal to the critical pressure of the solvent. A first heavy phase comprising asphaltenes, organometallic compounds, and solvent is recovered from the first separation zone. A first light phase is recovered from the first separation zone and introduced into a second separation zone which is maintained at a temperature higher than the temperature in the first separation zone. A second heavy phase comprising resins and solvent is withdrawn from the second separation zone and a portion of the second heavy phase is recycled to the upper portion of the second separation zone. A second light phase comprising deasphalted oil and solvent is recovered from the second separation zone. In another broad embodiment, the patent teaches that the second light phase may be introduced into a third separation zone which is maintained at an elevated temperature and pressure to effect a separation of the second light phase into a third light phase comprising solvent and a third heavy phase comprising deasphalted oils having a reduced metals content. Each separation zone is maintained at supercritical conditions.

U.S. Pat. No. 4,482,453 (Coombs et al.) teaches a process in which a hydrocarbon feed is contacted with a solvent in a first extraction vessel maintained at supercritical conditions. A first light phase is withdrawn from the first extraction vessel and fed to a separation zone which is maintained at supercritical conditions. A light phase comprising solvent and some oil is withdrawn from the separation zone and reused in the first extraction zone. A heavy phase is withdrawn from the separation zone and passed into a stripper where it is separated into a solvent stream and a deasphalted oil stream. The heavy phase from the first extraction vessel is passed into a stripper where an asphalt product is separated from solvent. A portion of the asphalt product is recycled to the first extraction vessel. In another embodiment, a third supercritical extraction is utilized, in addition to the first extraction vessel and the separation zone, which is termed the second extraction vessel in this embodiment. An intermediate resin product is withdrawn from the second extraction zone. A light phase from the second extraction zone is supplied to the third extraction zone, from which a product oil stream and a solvent stream are recovered.

U.S. Pat. No. 3,380,732 (Gatsis) teaches the utilization of two solvent extraction zones to recover a deasphalted oil containing resins which are convertible to more valuable products and to reject an asphaltic pitch. A first solvent extraction is carried out at particular conditions to provide a deasphalted oil and a solvent-lean hydrocarbon phase containing both resins and asphaltic material. This hydrocarbon phase constitutes the charge to the second solvent extraction zone which utilizes a selective solvent containing at least one more carbon atom per molecule than the solvent utilized in the first extraction zone. Deasphalted oil from the second extraction zone is added to the product stream from the first extraction zone. The heavy phase from the second extraction zone is an asphaltic residuum.

U.S. Pat. No. 3,972,807 (Uitti et al.) discloses a process in which a first light phase comprised of deasphalted oil and solvent and a first heavy phase comprising asphalt is withdrawn from a separation zone. An intermediate stream is withdrawn from the separation zone and passed into a settling vessel from which a second light phase and a second heavy phase are recovered. The second light phase is introduced into the separation zone at a location above the withdrawal point of the intermediate stream and below the deasphalted oil withdrawal point. The second heavy phase is introduced into the lower portion of the extraction zone at a location above the asphalt draw-off point and below the intermediate stream withdrawal point.

U.S. Pat. No. 4,124,486 (Nolley, Jr.) discloses a process for the efficient separation of a mixture emanating from a heavy oil solvent extraction process into solvent and deasphalted oil. The process includes a solvent flash step and a solvent fractionation step.

BRIEF SUMMARY OF THE DRAWING

The single drawing presented herein is a schematic representation of a process for deasphalting and demetallizing a heavy oil. Apparatus for recovering three streams is depicted, a DMO stream and two by-product streams termed a resin stream and a pitch stream. If only two products are desired, all of the resin stream is recycled to the extractor and the resin stripper and equipment associated with it is deleted.

BACKGROUND OF THE INVENTION

The process of the present invention is an extension of the well-known propane deasphalting process. The principle utilized in a solvent deasphalting process is that contacting a liquid solvent consisting of one or more light paraffins with a heavy oil will cause resins and asphaltenes to precipitate out of the mixture. Many of the contaminants present in heavy oils will accompany the resins and asphaltenes in the solid phase. A light phase comprising a DMO and solvent mixture is separated from the heavy phase and then further treated to separate the two components. The separation may be effected by raising the temperature of the mixture, since the solubility of DMO in solvent decreases as the temperature of the mixture is increased.

The process of the present invention is most advantageously applied to those heavy hydrocarbon oils known as black oils. Examples of black oils include vacuum tower bottoms (vacuum residua), atmospheric tower bottoms products, crude oil residua, topped or reduced crude oils, oils recovered from tar sands, coal liquids, and shale oil. Black oils are generally characterized in the art as having a boiling range such that at least ten percent (by volume) or more boils above a temperature of about 1050° F. (838.5K). Black oils usually contain, in addition to resins and asphaltenes, metals, nitrogen compounds, sulfur compounds, and coke precursors. In order to process a black oil to obtain lighter products, such as gasoline and diesel fuel, heavy metals and coke precursors must be substantially removed, before it is fed to a conversion zone for obtaining such light products. The metals content of a hydrocarbon conversion unit feed stream determines the ultimate catalyst requirement for the conversion unit, since metals are a permanent poison to the catalyst, deactivating it such that it cannot be regenerated in the normal manner. Heavy metals, such as iron, vanadium and nickel, have a particularly deleterious effect on catalyst. The concentration of coke precursors in a hydrocarbon conversion unit feed, which may be expressed as Conradson carbon residue, determines the processibility of the feed. A high Conradson carbon content indicates that the rate of coke deposition on the catalyst will be rapid and requires that the process be operated at lower severity and the resultant lower yield of products. A DMO having excessive amounts of nitrogen and/or sulfur may be subjected to hydrotreating before it is supplied to, for example, a fluid catalytic cracking unit.

The process of the present invention is energy intensive. Very little energy is required to make the initial separation between the DMO and asphalt phases; the solvent performs that task. Most of the energy required by the process is used in the separation of solvent and DMO. The use of supercritical solvent recovery is preferred, though not required, in the practice of the present process. The critical temperature of a substance is the temperature above which the gaseous form of the substance cannot be liquefied, no matter how high the pressure. A supercritical substance is a substance existing at a temperature above its critical temperature. At ambient pressure, a gas above its critical temperature behaves about like any other gas, but as it is subjected to increasingly higher pressure, its character changes. It expands to fill the confines of a container like a gas, but its density approximates that of a liquid. As the density of a supercritical substance is increased, it can dissolve substantial quantities of compounds that are at best only sparingly soluble in the substance at less than supercritical conditions. Lowering the density of a supercritical substance causes it to drop its burden of dissolved and entrained material. This can be done either by reducing the pressure (at constant temperature) or by increasing the temperature (at constant pressure). Heating a stream comprised of DMO and solvent to a temperature above the critical temperature of the solvent causes the DMO to separate from the solvent.

The process of the present invention may be configured to yield two products or three products. The main product of the process, demetallized oil, is usually supplied to a hydrocracking unit or fluid catalyst cracking unit as the feed stream, either alone or in combination with another stream. The by-product from a two product unit is often termed pitch. Pitch may be combined with a cutter stock and then added to the heavy fuel oil pool. A cutter stock, such as FCC light cycle oil, is usually required in order to meet either viscosity or sulfur specifications for heavy fuel oil. To minimize the cutter stock requirement, pitch can first be visbroken. Alternatively, pitch may be disposed of by mixing it with asphalt for use in roofing or road-building, where it acts as a hardening component due to its high softening point. Pitch may also be processed further to produce a solid fuel which may be used to supplement or replace coal or coke in many applications.

In a three product operation, a second by-product termed resin is produced. Resin is a heart cut, that is, it is intermediate in quality between DMO and pitch. Three product operation offers an additional degree of freedom, in that DMO quality and pitch yield can be independently controlled; resin may then be blended back into either the DMO or the pitch or both, in quantities which cause the DMO and/or pitch to approach their quality limits. For example, resin may be used as fluid catalytic cracking unit feed along with the DMO, until the Conradson carbon or metals limit for the feed stream is reached. In certain cases, it may be desirable to increase DMO quantity by including more resin in the DMO stream and then hydrotreating it, either alone or in combination with another stream. The product from the hydrotreating unit is then used to feed a fluid catalytic cracking unit. Resins may be used in asphalt or asphalt blends. Although they are low in asphaltene content, they contain large amounts of naphthene and polar aromatics and thus have good asphalt properties. Also, resin may be combined with cutter stock and used in fuel oil. Alternatively, to minimize fuel oil production and cutter stock requirements, it may be desirable to visbreak the resin. Visbreaking is mild thermal cracking of heavy oils to obtain lighter products, such as fuel oil and diesel fuel. Resin is easier to crack than pitch because of its low asphaltene content.

Of the solvents which may be used in the present process, propane is very selective and is used when DMO of the highest purity is required. Butanes may be utilized, either individually or mixed, as a solvent when a relatively high yield of clean DMO is desired. When butanes are used, the DMO is usually destined for processing by techniques using a metals-sensitive catalyst which can tolerate only several parts per million of nickel and vanadium in the feed, such as fluid catalytic cracking or hydrocracking to yield lighter distillates. When a maximum recovery of DMO is desired, isopentane and/or normal pentane may be employed as the solvent. The DMO produced using pentane will have relatively high levels of metals, Conradson carbon, sulfur, and nitrogen, thereby requiring more severe downstream processing. In certain cases, it may be desirable to use hexane as the solvent, either alone or in combination with lighter paraffins. Mixtures of the other solvents discussed above may also be utilized.

DETAILED DESCRIPTION OF THE INVENTION

The Drawing will now be utilized in describing a particular preferred deasphalting and demetallizing process in which the improvement comprising the present invention is employed. The use of this embodiment is not intended to limit the broad scope of the invention as presented in the claims. The drawing depicts only elements and equipment which are essential to a clear understanding of the process and the invention. Application and use of additional required items is well within the purview of one skilled in the art.

A heavy oil feedstream in pipeline 1 is supplied to extractor 2, which has a scrubber section 3. Fresh solvent is supplied to extractor 2 through pipeline 30 and a resin recycle stream, which will be described later, is provided to the extractor by means of pipeline 29. The extractor vessel may contain any of the well-known apparatus for effecting contact of two liquid streams. Alternatively, the extractor may be operated without internal apparatus or with internals located only in portions of the vessel. A first light phase stream is removed from the top of extractor 2 through pipeline 23.

A first heavy phase flowing downward in the extractor enters the scrubber section 3 of the extractor. In the scrubber section, the heavy phase is washed by countercurrent contact with solvent added to scrubber section 3 by means of pipeline 4. Scrubber section 3 may be provided with internal apparatus to facilitate contacting of the phases. The first heavy phase stream is conveyed from the scrubber section to heater 12 by pipeline 52 and, after heating of the stream is accomplished, to pitch stripper 11 by means of pipeline 56. Solvent contained in the first heavy phase stream is separated and leaves stripper 11 as an overhead stream in pipeline 37. Steam from pipeline 51 is added to the base of stripper 11 to remove the traces of solvent remaining after the bulk of the solvent separates out in the extractor and the steam then passes into pipeline 37 with the solvent. Pitch is removed from stripper 11 via pipeline 54.

The light phase stream from extractor 2 is increased in temperature in heat exchanger 5 and passed into resin settler 6 through pipeline 55. The resin settler preferably contains only internals adapted to distribute feed and collect the light phase without causing turbulence but may contain phase contacting apparatus and/or phase separation enhancement devices. Wash section 7 is shown in the Drawing as a part of resin settler 6.

In resin settler 6 an initial separation takes place to produce a second light phase stream and a second heavy phase stream. In the improvement which constitutes the present invention, the second heavy phase stream passes downward through wash section 7. There it is countercurrently contacted with wash solvent provided by pipeline 25. The wash solvent passes upward through several contact stages, dissolving additional DMO from the downward flowing second heavy phase. The solvent-DMO solution emerging from the uppermost contact device in wash section 7 constitutes a third light phase stream. This combines with the second light phase stream to provide an increased amount of DMO product.

All of the DMO which constitutes the DMO product stream recovered from from DMO stripper 14 after passage through DMO separator 8 is a part of the second light phase stream. Thus, it can be appreciated that all of the solvent which is contained in the second heavy phase also contains DMO in the same concentration as the solvent which comprises the second light phase. The present invention recognizes this and provides a method for recovery of DMO from the second heavy phase. The substances comprising the second heavy phase entering the wash section, where the invention is carried out, have already given up their content of DMO, but a portion of DMO remains as part of the solvent and is recovered by displacing DMO-enriched solvent with wash solvent.

The combined light phase stream flows out of resin settler 6 and is conveyed to heat exchanger 16 by pipeline 27. After the combined light phase stream is heated in heat exchanger 16, it is conveyed to heater 15 by pipeline 39 where the temperature is further increased. The combined light phase stream is then conveyed to DMO separator 8 via pipeline 38. In a preferred mode, the temperature of the combined light phase stream is raised to a value above the critical temperature of the solvent before the stream enters DMO separator 8. The critical temperature of a material is the temperature above which it cannot be liquefied or condensed via pressure changes. A material's critical pressure is the pressure under which it may exist as a gas in equilibrium with the liquid at its critical temperature. A third heavy phase stream, comprising DMO and solvent is conveyed from DMO separator 8 to DMO stripper 14 by pipeline 46. In DMO stripper 14 solvent is flashed and removed as overhead product through pipeline 36. Steam is added to the base of DMO stripper 14 by means of pipeline 47 in order to remove substantially all solvent from the DMO. In this and the other strippers, steam may be replaced with another substance such as nitrogen. Steam exits DMO stripper 14 with the solvent vapors in pipeline 36. DMO product is removed from the bottom of the DMO stripper by pipeline 48.

Supercritical solvent leaves DMO separator 8 through pipeline 40 and passes through heat exchanger 16 in order to provide heat to the combined light phase stream. Solvent leaving heat exchanger 16 via pipeline 24 passes through heat exchanger 5, in order to heat the first light phase stream from extractor 2, and then is conveyed to cooler 17 by pipeline 44. After additional heat is rejected to the atmosphere utilizing cooler 17, solvent is conveyed via pipeline 45 to pipeline 30, where it is mixed with a solvent stream from pipeline 31 to form the fresh solvent stream supplied to extractor 2.

The heavy phase stream leaving wash section 7 of resin settler 6 in pipeline 28 may be passed, in whole or in part, through heater 9. A preferred mode of operation is to return a portion of the heavy phase stream to extractor 2 by means of pipeline 29. The return stream is termed a resin recycle stream. The flocculation of asphaltenes in the extractor is improved by use of a recycle stream, thus improving product quality. That portion of the resin stream which is heated in heater 9 is conveyed to resin stripper 18 by means of pipeline 49. Steam is provided to stripper 18 by pipeline 50. A solvent and water vapor stream is withdrawn from resin stripper 18 by means of pipeline 35. The resin by-product is withdrawn from resin stripper 18 through pipeline 34. In a two product operation, where the products are DMO and pitch, the entire resin stream from wash section 7 is recycled back to the extractor. When the invention is practiced, it has been found that the flow rate of the recycle stream may be decreased by about 25%, without any deleterious effect. This allows smaller equipment, such as the resin recycle pump, to be used.

The three solvent and water streams from strippers 11, 14 and 18 are combined and passed through pipeline 36 to cooler 10. Condensed solvent and water leaving cooler 10 is conveyed to low-pressure drum 13 by pipeline 53. Water is separated from solvent in drum 13 and exits through pipeline 32. Make-up solvent is added to the recovered solvent in drum 13 by pipeline 33. Solvent which is termed lowpressure solvent is withdrawn from drum 13 by pipeline 31 and mixed with solvent from line 45 to produce the fresh solvent which is fed to extractor 2 via pipeline 30.

The wash solvent which is used to increase DMO production is drawn in part from drum 13 via pipelines 31 and 26. A portion of solvent flowing in line 24, which is at a relatively high pressure, is diverted by means of pipeline 25 and mixed with the low pressure solvent in line 26 to form the wash stream. The quantity of hot solvent which is mixed with the cold solvent to form the wash solvent stream is varied by means of control valve 19. Controller 20 senses wash solvent stream temperature and adjusts valve 19 to maintain a previously determined value. Flow of the wash solvent stream is sensed by flow controller 22, which provides a signal to control valve 21 to maintain the flow at a previously established value.

If the wash solvent is too hot, an excessive amount of DMO will be recovered in the wash section, thereby carrying unwanted contaminants into the DMO product. If the wash stream is too cold, the recovery of DMO by means of the wash step will be decreased. The dashed lines denoted by reference numbers 41, 42, and 43 and labeled "alternates" depict pipelines which may be used to provide all or a portion of the wash solvent.

Exemplary physical parameters are as follows. The supercritical temperature for isopentane is about 280° F. (411K). When isopentane is used as a solvent, the extractor may be operated at about 200° F. (366K) and at a pressure sufficient to maintain the solvent at liquid form, about 500–600 psig (3548–4238 kPaa). The resin settler would then be operated at a temperature from about 220 to about 275 degrees Fahrenheit (377–408K). The DMO separator would be operated at a temperature ranging from supercritical to about 325° F. (436K).

In experimentation directed to showing the effect of the invention, a vacuum residuum stream was charged to deasphalting and demetallizing apparatus similar to that depicted in the Drawing. Normal butane was the solvent. At a particular set of steady-state operating conditions, without practice of the invention, the quantity of each product stream was measured. The apparatus was then operated at the same conditions, except that a washing step in accordance with the invention was added. Solvent for the wash step was withdrawn from the locations indicated in the Drawing—pipelines 25 and 26—at such rates that the total wash solvent stream was at the same temperature as the contents of the resin settler and wash section. The rate of flow of fresh solvent to the extractor was diminished by the flow of wash solvent.

The following product quantities are typical of the values recorded with and without the practice of the invention. The values are expressed in weight percent of the total of the three product streams.

| | Without | With the invention |
|---|---|---|
| DMO | 21.9 | 26.8 |
| Resin | 49.7 | 43.7 |
| Pitch | 28.4 | 29.5 |
| | 100.0 | 100.0 |

The percentage of DMO recovered was improved by about 5 percentage points, while the amount of resin produced decreased a commensurate amount. In this particular example, the amount of pitch produced increased slightly. The increase in the amount of DMO produced attributable to the invention was about 22.4%.

The vessels described herein as locations where countercurrent contacting steps take place may contain internal apparatus which is useful in facilitating intimate mixing and disengagement of phases. However, phase separation may take place in vessels which are devoid of internals. Such internals are well known by those skilled in the art and may include apparatus known as packing, an example of which is Pall rings. A further example of such apparatus is various types of trays, which may have valves or bubble caps disposed in them, in addition to weirs for retaining a substance on the tray and downcomers for conveying a phase from tray to tray. U.S. Pat. No. 3,972,807, which is cited above, depicts examples of internal contacting apparatus. The drawing of that patent shows trays comprised of perforated plates and downcomers arranged to cause side to side flow of liquid over the trays.

In the Drawing herein, the washing step which constitutes the present invention is accomplished in wash section 7, which is shown attached to resin settler 6. The invention may also be practiced in a vessel which is separate from the resin settler.

The invention may be practiced using solvents other than the light paraffins mentioned herein.

What is claimed is:

1. A deasphalting and demetallization process for heavy fractions of crude oil comprising:

(a) supplying a hydrocarbon feed stream comprising a heavy oil to an extraction zone;

(b) supplying a fresh solvent stream to said extraction zone;

(c) contacting said hydrocarbon feed stream with said fresh solvent stream in said extraction zone and recovering therefrom a first light phase stream and a first heavy phase stream;

(d) heating said first light phase stream and supplying said first light phase stream to a settling zone, wherein a second light phase stream comprising solvent and deasphalted and demetallized oil is separated from a second heavy phase stream comprising resins, oil, and solvent;

(e) countercurrently contacting said second heavy phase stream with a fresh wash solvent stream in a resin wash zone in order to displace deasphalted and demetallized oil and thereby to obtain a third light phase stream comprising solvent and deasphalted and demetallized oil and a third heavy phase stream comprising resins and solvent;

(f) combining said second light phase stream with said third light phase stream, heating the combined stream, and supplying the combined stream to a separation zone;

(g) recovering from said separation zone a fourth light phase stream comprised of solvent and a fourth heavy phase stream comprised of solvent and deasphalted and demetallized oil; and, (h) passing at least a portion of said fourth heavy phase stream into a first steam stripping zone and recovering therefrom a stream comprising solvent and water and a stream comprising deasphalted and demetallized oil.

2. The process of claim 1 further characterized in that said combined stream of step 1 (f), which is comprised of said second and third light phase streams, is heated to a temperature above the critical temperature of the solvent.

3. The process of claim 1 further characterized in that said wash solvent stream temperature is adjusted to be equal to or less than the temperature of said second heavy phase stream, so that contacting said wash stream with said second heavy phase stream causes no precipitation of solid matter.

4. The process of claim 1 wherein said heavy oil is comprised of coke precursors, resins, metals, sulfur, nitrogen, and asphaltenes.

5. The process of claim 1 further characterized in that said solvent is selected from a group comprising propane, butane, pentane, hexane, and mixtures thereof.

6. The process of claim 1 further characterized in that a recycle stream is supplied to said extraction zone and contacted therein with said hydrocarbon feed stream and said fresh solvent stream, where said recycle stream is comprised of at least a portion of said third heavy phase stream of step 1 (e).

7. The process of claim 1 further characterized in that said first heavy phase stream is passed into a steam stripping zone wherefrom a pitch stream and a stream comprised of water and solvent is withdrawn.

8. The process of claim 1 further characterized in that said first heavy phase stream emanating from said extraction zone is countercurrently contacted with a fresh solvent stream in a scrubbing zone and the resultant used solvent stream emanating from the scrubbing zone is passed into the extraction zone.

9. The process of claim 1 further comprising the steps of:

(a) supplying at least a portion of said third heavy phase stream of step 1 (e) to said extraction zone as a recycle stream;

(b) contacting at least a portion of said first heavy phase stream with steam in a second steam stripping zone and recovering therefrom a pitch stream and a stream comprised of solvent and water;

(c) contacting at least a portion of said third heavy phase stream with steam in a third steam stripping zone and recovering therefrom a resin stream and a stream comprised of solvent and water;

(d) combining a make-up solvent stream with said solvent and water streams from said first, second, and third steam stripping zones and separating said combined stream into a water stream and a solvent stream;

(e) mixing a first portion of said solvent stream from step 9 (d) with a first portion of said fourth light phase stream from step 1 (g) to form said wash solvent stream of step 1 (e); and, (f) mixing a second portion of said solvent stream from step 9 (d) and a second portion of said fourth light phase stream from step 1 (g) to form said fresh solvent stream of step 1 (b).

10. The process of claim 9 further characterized with respect to step (e) in that said wash solvent stream is maintained at a previously established temperature by varying the quantity of said fourth light phase stream which is mixed with said solvent stream from step 9 (d).

* * * * *